US006837091B2

(12) United States Patent
Brochheuser et al.

(10) Patent No.: US 6,837,091 B2
(45) Date of Patent: Jan. 4, 2005

(54) TUBE DRAWING METHOD AND DEVICE

(75) Inventors: Ulrich Brochheuser, Neunkirchen (DE); Horst Statezni, Lohmar (DE)

(73) Assignee: GKN Automotive GmbH (DE)

( * ) Notice: Subject to any disclaimer, the term of this patent is extended or adjusted under 35 U.S.C. 154(b) by 0 days.

(21) Appl. No.: 10/118,781

(22) Filed: Apr. 9, 2002

(65) Prior Publication Data

US 2002/0170331 A1 Nov. 21, 2002

(30) Foreign Application Priority Data

Apr. 11, 2001 (DE) ..... 101 18 032

(51) Int. Cl.[7] ..... B21C 1/26
(52) U.S. Cl. ..... 72/283; 72/284
(58) Field of Search ..... 72/283, 284, 278, 72/282

(56) References Cited

U.S. PATENT DOCUMENTS 441,927 A * 12/1890 Bray ..... 72/283
2,270,398 A * 1/1942 Westin ..... 72/276
2,597,500 A * 5/1952 Kerr ..... 72/283
2,886,170 A * 5/1959 Kerr ..... 72/283
5,487,292 A * 1/1996 Fox ..... 72/43

FOREIGN PATENT DOCUMENTS

| | | | | |
|---|---|---|---|---|
| CA | 573431 | * | 4/1959 | 72/283 |
| DE | 2218667 | * | 4/1973 | 72/283 |
| DE | 34 37 123 C2 | | 8/1986 | |
| DE | 35 06 220 A1 | | 12/1992 | |
| SU | 835555 | * | 6/1981 | 72/284 |

* cited by examiner

*Primary Examiner*—Daniel C. Crane

(57) ABSTRACT

A method of elongating a tube (10) by way of a drawing ring (13), wherein, when elongating the tube (10), tensile forces are applied to an elongated tube portion (22) which has already passed through the effective drawing ring cross-section and that pressure forces are applied to a tube blank portion (11) which has not yet passed through the effective drawing ring cross-section, wherein the tensile forces are applied by a mandrel (16) which is positioned in the tube and which is connected to a front tube end in a form-fitting or force-locking way.

17 Claims, 2 Drawing Sheets

TUBE DRAWING METHOD AND DEVICE

TECHNICAL FIELD

The present invention relates to method of elongating a tube by way of a drawing ring, and to a device for elongating a tube.

BACKGROUND OF THE INVENTION

The invention relates to a method of elongating a tube by way of a drawing ring, and to a device for elongating a tube. Elongating methods of said type are used in those cases where there is a need for one-piece (non-assembled) tubular members whose wall thicknesses differ in the longitudinal direction. Such applications are so-called mono-block intermediate shafts, for example, which comprise a longer central portion with a smaller wall thickness and two end portions with a greater wall thickness and, at the same time, with a smaller outer diameter. For producing such shafts it is common practice to start with a straight cylindrical blank, i.e. a simple tubular portion of which, first, the front end is reduced in order to form the first tube end, then to elongate the major part of the tube length over a mandrel in order to produce the central portion with a smaller wall thickness and finally to reduce the rear, non-elongated tube end in order to produce the second tube end. An example of this is shown in German patent DE 35 06 220 A1.

Elongation takes place in such a way that a mandrel is inserted into the tube from the rear end of same. The mandrel supports the tubular member from the inside, and the front end of the mandrel, on the inside, rests against the reduced front end portion of the tubular member.

The mandrel together with the surrounding tubular member is then pushed through a drawing ring. While the inner diameter of the tubular member is supported, the outer diameter is reduced, with the tube simultaneously being elongated when passing through the effective cross-section of the drawing ring. From the beginning of the process, the reduced tube portion is subjected to tensile forces, with the tensile forces being higher the greater the degree of deformation, i.e. the greater the change in diameter or the greater the speed of feed respectively.

Thus, there exists a need for an improved tube drawing process to increase tool service life and/or shorten drawing cycle times.

SUMMARY OF THE INVENTION

The present invention provides a more effective tube drawing method which achieves a longer service life for the tools or shorter cycle times during deformation. In the present invention, when elongating the tube, tensile forces are applied to an elongated tube portion which has already passed through the effective drawing ring cross-section. Pressure forces are also applied to a tube blank portion which has not yet passed through the effective drawing ring cross-section. The tensile forces are applied by a mandrel which is positioned in the tube and which is connected to a front tube end in a form-fitting or force-locking way.

In this way, it is possible to reduce the forces acting at the drawing ring necking on the tube, because tensile forces and pressure forces act simultaneously on both sides of the necking. With a given rate of deformation, it is thus impossible for the elongated tube to tear as a result of the tensile forces applied by the mandrel. On the contrary, it is possible to increase the rate of deformation considerably before critical tensile forces are reached. The maximum tensile force has to be limited to a value which, while observing certain safety measures, is below the value of the tearing force of the elongated portion.

For connecting the mandrel to the front end of the tube, it is possible to provide special clamping devices for the tube end, or a tension rod can temporarily be welded to the tube end.

For applying pressure forces to the rear end of the tube, use is preferably made of a sleeve whose cross-section corresponds to the cross-section of the tube and which is attached co-axially to the tube.

With a path-controlled device, the speed of feed of the front end of the tube is set to be greater than the speed of feed of the rear end of the tube. In particular, a constant speed ratio should be maintained. The required speed ratio is achieved by suitably controlling the feeding cylinders for the mandrel and the sleeve.

According to a further preferred method, particularly suited for producing intermediate shafts of the current type, a front portion of the tube is reduced prior to being elongated. Thus, the front portion can be passed through the drawing ring in a force-free way.

It is possible for the front end of the mandrel to come to rest on the inside against the reduced front portion of the tube without there being any need for further aids for introducing force into the front end.

According to a further embodiment of the method—again in connection with the production of intermediate shafts—a rear portion of the tube is first left unelongated in that it is not guided through the drawing ring. In such a case, the rear portion of the tube is reduced after the tube has been withdrawn from the drawing ring and after the mandrel has been removed. The front portion and the rear portion can be reduced by drawing methods using different tools with smaller cross-sections. In addition, round hammering or round kneading can be used for reducing purposes.

In the case of such reducing methods, the end portions can be provided directly with shaft toothings by using drawing tools or round hammering or round kneading tools with the respective profiles.

An inventive device for elongating a tube, in addition to the drawing ring, includes a mandrel whose outer diameter approximately corresponds to the inner diameter of the tube, and a drawing ring whose inner diameter is smaller than the outer diameter of the tube and greater than the outer diameter of the mandrel, as well as a sleeve which is co-axially guided in the mandrel, with the mandrel having to be advanced at a greater speed than the sleeve. The sleeve can be connected to a first feeding cylinder and the mandrel to a second feeding cylinder which is guided in the first feeding cylinder. The mode of operation of this device has already been described above.

Other advantages of the invention will become apparent upon reading the following detailed description and appended claims, and upon reference to the accompanying drawings.

BRIEF DESCRIPTION OF THE DRAWINGS

For a more complete understanding of this invention, reference should now be made to the embodiments illustrated in greater detail in the accompanying drawings and described below by way of examples of the invention.

DETAILED DESCRIPTION OF THE INVENTION

Figure 1:
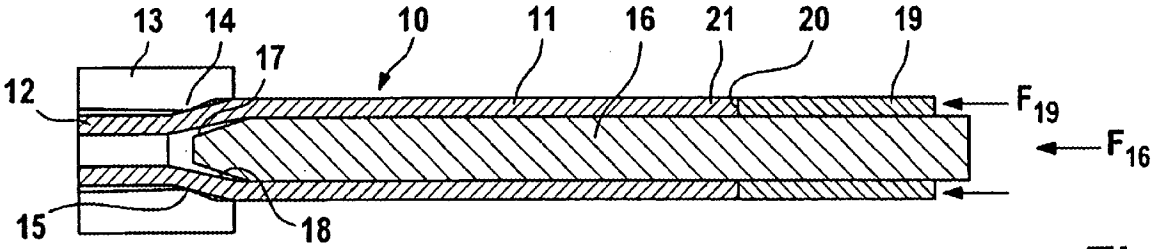
FIG. 1 shows the blank whose first tube end has already been reduced at the beginning of the elongating process according to the present invention.

FIG. 1 shows a tube 10 with a blank portion 11 and a reduced end portion 12 at the front, which end portion 12 is introduced into a drawing ring 13 comprising a necking 14. FIG. 1 represents the blank 11 at the beginning of the drawing process according to the present invention. An outer conical shoulder 15 of the tube 10 abuts against the necking 14 in the region of transition from the blank portion 11 to the reduced end portion 12. Into the tube 10 there is inserted a mandrel 16 whose conical point 17 rests against the inner conical shoulder 18 of the tube 10 in the region where the blank portion 11 changes into the reduced end portion 12 at the front.

A sleeve 19 whose cross-section is identical to that of the tube 10 and whose front face 20 rests against the rear tube end 21 is slid on to the mandrel 16. A first force $F_{19}$ is applied to the sleeve 19 and a force $F_{16}$ acting in the same direction is applied to the mandrel 16, both of the forces acting towards the drawing ring 13. The force $F_{19}$ acts on the blank portion 11 in the form of a pressure force and the force $F_{16}$ acts on the region of transition between the blank portion 11 and the reduced end portion 12 in the form of a pressure force, with a counter force at the necking 14 applied by the drawing ring 13 acting against the pressure forces.

Figure 2:
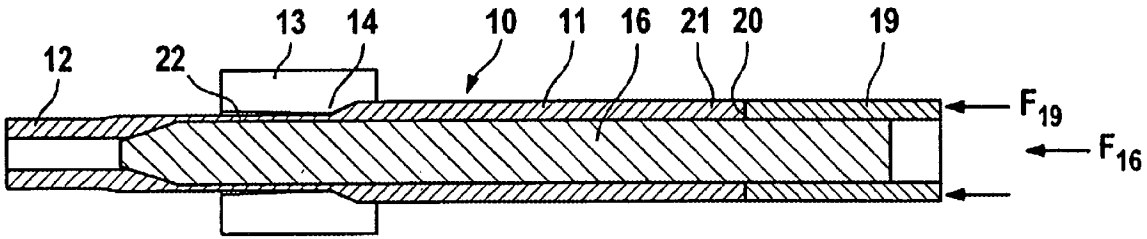
FIG. 2 shows the tube according to FIG. 1 during an intermediate elongation phase.

In FIG. 2, the tube 10 with the inserted mandrel 16 has already been pushed partially past the necking 14 through the drawing ring 13, and an elongatable portion 22 has been formed at the tube 10. While the force $F_{19}$ acting on the sleeve 19 continues to act in the form of a pressure force on the unreduced blank portion 11, which force is counter-acted by a counter force applied by the drawing ring 13 at the necking 14. The force $F_{16}$, in the form of a tensile force, acts via the mandrel point 17 and the inner conical shoulder 18 on the already reduced elongated portion 22 of the tube 10. As can be seen from the changed relative position of the mandrel 16 and the sleeve 19, the front tube end has a higher speed of feed than the unreduced blank portion 11. Preferably, a constant speed ratio is maintained between the mandrel 16 and the sleeve 19 by controlling the feed cylinders for the mandrel 16 and sleeve 19.

Figure 3:
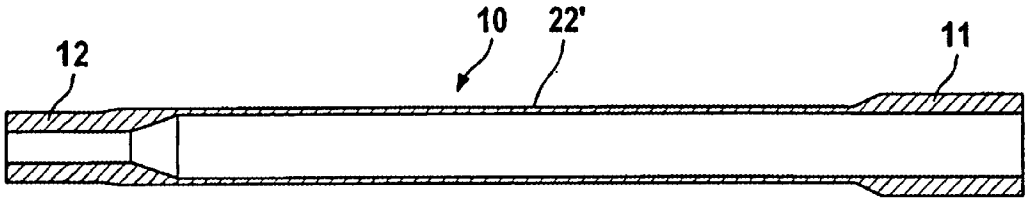
FIG. 3 shows the tube according to FIG. 2 after completion of the elongation operation.

In FIG. 3, the elongated portion 22' of the tube 10 has been given the required length and there remains only a short unreduced blank portion 11' whose axial length approximately corresponds to the length of the previously reduced first tube portion 12. The mandrel has already been withdrawn from the tube 10 and the reduced elongated portion 22' has been ejected backwards from the drawing ring.

Figure 4:
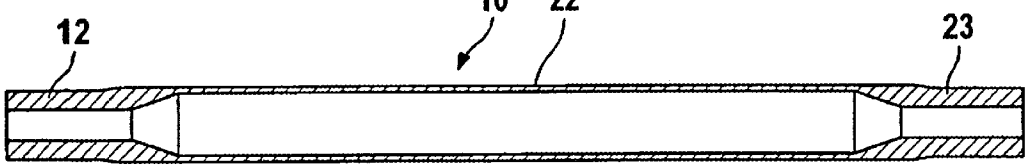
FIG. 4 shows the tube according to FIG. 3 after the final stage of reducing the second tube end.

FIG. 4 shows that the previously unreduced blank portion has been formed into a second reduced end portion 23 of the same shape as the first end portion 12, whereas the reduced elongated portion 22' has maintained its previous length. The finished product is an intermediate shaft, and if suitable reducing tools are used, shaft toothings can be provided at the end portions 12 and 23 at this stage already. At both tube ends, the reduction in the end portions can be achieved by drawing. However, in view of the fact that the reduced elongated portion 22 comprises a reduced bending strength, radial round hammering is more advantageous, at least for producing the second end portion 23.

Figure 5:
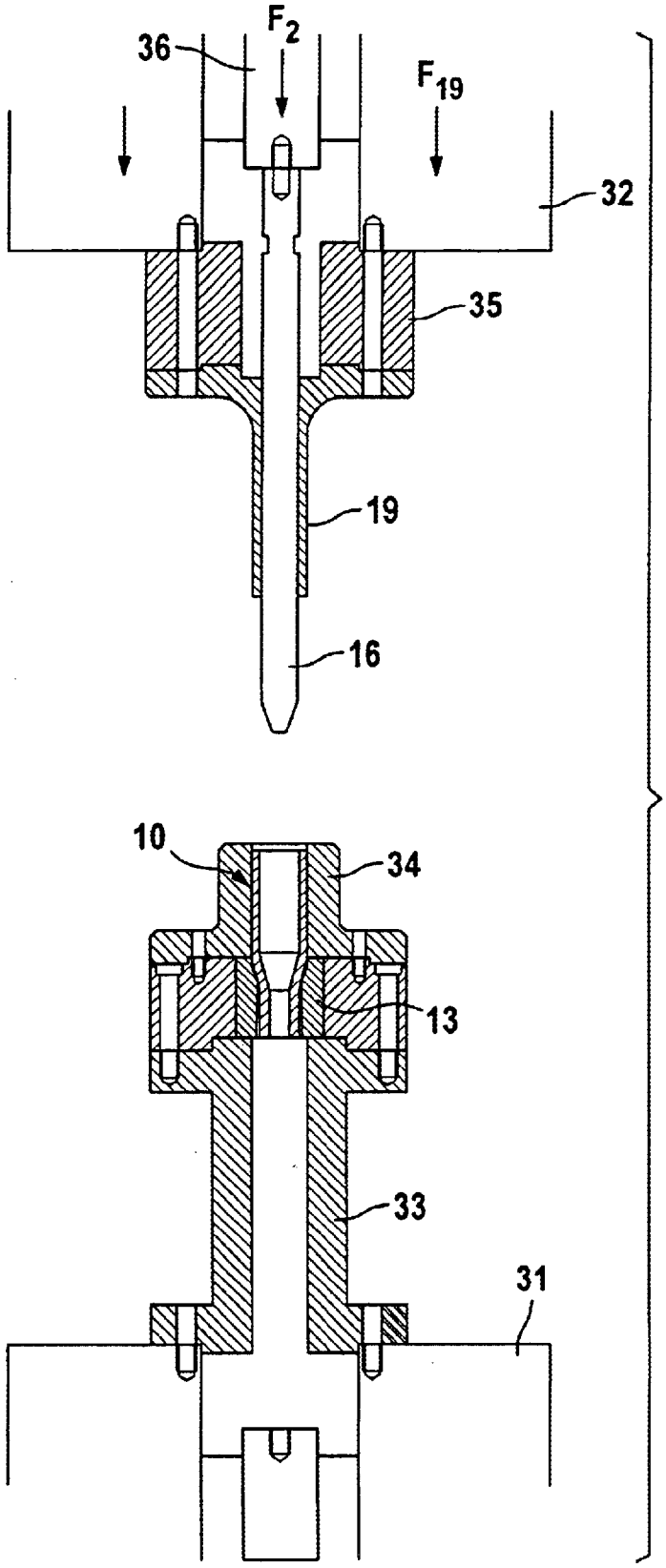
FIG. 5 shows a device according to the present invention with the lower tool (drawing ring) and the upper tool (mandrel/sleeve), with an inserted blank.

FIG. 5 shows a device comprising a lower punch 31 and an upper punch 32 which are both received by a machine frame (not illustrated). A die holding device 33 and tool guide 34 bolted thereto are fixed to the lower punch 31. Between the die holding device 33 and the tool guide 34, there is positioned a drawing ring 13. A tube 10 with a reduced first end portion of a configuration similar to that of FIG. 1 has been inserted into the tool guide 34 and into the drawing ring 13. The sleeve 19 is bolted via the tool holding device 35 to the upper punch 32 which can be provided in the form of a hydraulic cylinder. In the upper punch 32, there is guided a cylinder 36 to which there is secured the mandrel 16 which passes through the sleeve 19. The way in which the tools 32 and 36 are arranged corresponds to a cylinder-inside-cylinder assembly. The upper punch 32, together with its tools, i.e. the mandrel 16 and the sleeve 19, can be lowered on to the lower punch 31 and the mandrel 16 can be moved forward into the tube at an increased speed relative to that of the sleeve 19.

As shown in all of the Figures, the mandrel 16 has an outer diameter which approximately corresponds to the inner diameter of the tube 10, while the drawing ring 13 has an inner diameter which is smaller than the outer diameter of the tube 10, and greater than the outer diameter of the mandrel 16.

From the foregoing, it can be seen that there has been brought to the art a new and improved tube drawing method and device. While the invention has been described in connection with one or more embodiments, it should be understood that the invention is not limited to those embodiments. Thus, the invention covers all alternatives, modifications, and equivalents as may be included in the spirit and scope of the appended claims.

What is claimed is:

1. A method of elongating a tube with a drawing ring, the tube having a first end, a blank portion and a rear end, the method comprising the steps of:

passing the tube through an effective drawing ring cross section, starting with the first end;

applying tensile forces to an elongated tube portion having passed through the effective drawing ring cross section and applying pressure forces to a tube blank portion which has not yet passed through the effective drawing ring cross-section;

wherein the tensile forces are applied by a mandrel which is positioned in the tube and which is connected to a front end in a formfitting or force-locking way; and wherein the pressure forces are applied by a sleeve which is applied to the rear end of the tube.

2. A method according to claim 1, wherein a speed of feed of the first end of the tube is greater than a speed of feed of the rear end of the tube.

3. A method according to claim 2, wherein a ratio of the speed of feed of the first end to the speed of feed of the rear end is constant.

4. A method according to claim 1 comprising reducing a front portion of the tube prior to the tube being elongated.

5. A method according to claim 4, wherein a front end of the mandrel, on the inside, rests against the reduced front portion of the tube.

6. A method according to claim 4, wherein a rear portion of the tube remains non-elongated in that it is not guided through the drawing ring and the method comprises reducing the rear portion of the tube after the mandrel has been removed.

7. A method according to claim 4, wherein the front portion is reduced by being drawn.

8. A method according to claim 4, wherein the front portion is reduced by round hammering.

9. A method according to claim 4 comprising providing the front portion with splines while being reduced.

10. A method of elongating a tube with a drawing ring, the tube having a first end, a blank portion and a rear end, the method comprising the steps of:

passing the tube through art effective drawing ring cross section, starting with the first end;

applying tensile forces to an elongated tube portion having passed through the effective drawing ring cross section and applying pressure forces to a tube blank portion which has not yet passed through the effective drawing ring cross-section;

wherein the tensile forces are applied by a mandrel which is positioned in the tube and which is connected to a front end in a form-fitting or force-locking way; and wherein a rear portion of the tube remains non-elongated in that it is not guided through the drawing ring and the method comprises reducing the rear portion of the tube after the mandrel has been removed.

11. A method according to claim 10, wherein the rear portion is reduced by being drawn.

12. A method according to claim 11, wherein a front portion is reduced by being drawn.

13. A method of elongating a tube with a drawing ring, the tubs having a first end, a blank portion and a rear end, the method comprising the steps of;

passing the tube through an effective drawing ring cross section, starting with the first end;

applying tensile forces to an elongated tube portion having passed through the effective drawing ring cross section and applying pressure forces to a tube blank portion which has not yet passed through the effective drawing ring cross-section;

wherein the tensile forces are applied by a mandrel which is positioned in the tube and which is connected to a front end in a form-fitting or force-locking way; and wherein a rear portion of the tube remains non-elongated in that it is not guided through the drawing ring and the method comprises reducing the rear portion of the tube after the mandrel has been removed by round hammering.

14. A method according to claim 13, wherein a front portion is reduced by round hammering.

15. A method of elongating a tube with a drawing ring, the tube having a first end, a blank portion and a rear end, the method comprising the steps of:

passing the tube through an effective drawing ring cross section, starting with the first end;

applying tensile forces to an elongated tube portion having passed through the effective drawing ring cross section and applying pressure forces to a tube blank portion which has not yet passed through the effective drawing ring cross-section;

wherein the tensile forces are applied by a mandrel which is positioned in the tube and which is connected to a front end in a form-fitting or force-locking way; and wherein a rear portion of the tube remains non-elongated in that it is not guided through the drawing ring and the method comprises reducing the rear portion of the tube after the mandrel has been removed and providing the rear portion with splines while being reduced.

16. An apparatus for elongating a tube by way of a drawing ring comprising:

a mandrel having an outer diameter corresponding approximately to an inner diameter of the tube;

a drawing ring having an inner diameter smaller than an outer diameter of the tube and greater than an outer diameter of the mandrel; and a sleeve which is guided co-axially on the mandrel, wherein a front face of the sleeve is adapted to rest against a rear end of the tube, and wherein the mandrel is adapted to be advanced at a greater speed than the sleeve, and wherein the sleeve is connected to a first feeding cylinder and the mandrel is connected to a second feeding cylinder which is guided in the first feeding cylinder.

17. A method of elongating a tube with a drawing ring, the tube having a first end portion and blank portion, the method comprising the steps of:

passing the first end portion of the tube through an effective drawing ring cross section;

thereafter, applying tensile forces for elongating the tube through the drawing ring to form an elongated tube portion; and applying pressure forces to the tube blank portion which has not yet passed through the effective drawing ring cross-section, wherein the tensile forces are applied by a mandrel which is positioned in the tube and which is connected to a front end portion in a form-fitting or force-locking way; and wherein the pressure forces are applied by a sleeve which is guided co-axially on the mandrel, the sleeve renting with its front face against a rear end of the tube.

* * * * *